US009321296B2

(12) United States Patent
Dong et al.

(10) Patent No.: US 9,321,296 B2
(45) Date of Patent: Apr. 26, 2016

(54) FLAT-PEN AUTOMATIC ASSEMBLY LINE

(71) Applicant: Beifa Group Co., Ltd., Ningbo, Zhejiang (CN)

(72) Inventors: Cailiang Dong, Ningbo (CN); Feng Zhu, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 459 days.

(21) Appl. No.: 13/717,664

(22) Filed: Dec. 17, 2012

(65) Prior Publication Data

US 2013/0167371 A1 Jul. 4, 2013

(30) Foreign Application Priority Data

Dec. 29, 2011 (CN) ..... 2011 1 0450032

(51) Int. Cl.
*B43K 15/00* (2006.01)
*B43K 15/02* (2006.01)

(52) U.S. Cl.
CPC ..... *B43K 15/02* (2013.01); *Y10T 29/53543* (2015.01)

(58) Field of Classification Search
CPC ..... B43K 15/02; Y10T 29/53543; Y10T 29/53478; B65G 17/12; B23K 11/00; B23K 7/00
See application file for complete search history.

(56) References Cited

U.S. PATENT DOCUMENTS

| | | | | |
|---|---|---|---|---|
| 2,160,735 A | | 5/1939 | Hoffer | |
| 2,405,367 A | | 8/1946 | Nichols, Jr. | |
| 2,672,630 A | | 3/1954 | Bitzer | |
| 2,969,030 A | | 1/1961 | Kahn | |
| 3,162,941 A | * | 12/1964 | Young | 29/441.1 |
| 3,246,502 A | | 4/1966 | Brignoli | |
| 3,281,933 A | | 11/1966 | Fehling | |
| 3,496,627 A | | 2/1970 | Mazzier | |
| 3,578,142 A | | 5/1971 | Burgess, Jr. | |
| 3,581,378 A | | 6/1971 | Jozens | |
| 3,620,264 A | | 11/1971 | Klein | |
| 3,708,854 A | | 1/1973 | Nalbach | |
| 3,729,269 A | | 4/1973 | Koeln | |
| 3,776,673 A | | 12/1973 | DeGroft | |

(Continued)

FOREIGN PATENT DOCUMENTS

| | | |
|---|---|---|
| DE | 2017459 | 10/1971 |
| DE | 2226920 | 12/1973 |
| SU | 1444172 A1 | 12/1988 |

*Primary Examiner* — Jacob Cigna
*Assistant Examiner* — Lee A Holly
(74) *Attorney, Agent, or Firm* — Christensen O'Connor Johnson Kindness PLLC

(57) ABSTRACT

A flat-pen automatic assembly line system includes a worktable, two sprockets, and an endless loop driving chain connecting the two sprockets. The two sprockets are mounted at the two ends of the worktable, respectively. A plurality of jigs on the driving chain receives pen barrels. A transporting rail supporting the driving chain is provided between the two sprockets. A pen-cap mounting station and a pen-cap pressing station are provided on the same worktable successively, and the pen-cap pressing station is provided with an automatic pen-cap pressing machine. The pen-cap mounting process and the pen-cap pressing process are completed on the same worktable and these two processes are linked via the same driving chain. Therefore, the assembly time is shortened and the assembly efficiency is improved. Furthermore, the pen-cap pressing process may employ an automatic pen-cap pressing machine. Therefore, labor can be reduced further, and assembly efficiency can be improved.

6 Claims, 5 Drawing Sheets

(56) References Cited

U.S. PATENT DOCUMENTS

| | | | | | |
|---|---|---|---|---|---|
| 3,800,496 | A | | 4/1974 | Bardet | |
| 3,815,726 | A | | 6/1974 | Klein | |
| 3,862,486 | A | | 1/1975 | McArdle | |
| 3,889,336 | A | | 6/1975 | Buchanan | |
| 3,959,870 | A | | 6/1976 | Klein | |
| 4,047,276 | A | | 9/1977 | Albers | |
| 4,071,949 | A | | 2/1978 | Ross | |
| 4,195,399 | A | | 4/1980 | Rasmussen | |
| 4,259,780 | A | | 4/1981 | Crawford | |
| 4,431,102 | A | | 2/1984 | Bittner | |
| 4,476,997 | A | | 10/1984 | Lacroix | |
| 4,498,234 | A | | 2/1985 | Greslin | |
| 4,518,972 | A | | 5/1985 | Gunderson | |
| 4,576,286 | A | | 3/1986 | Buckley | |
| 4,635,338 | A | * | 1/1987 | Walsh | 29/436 |
| 4,747,294 | A | | 5/1988 | Schwartz | |
| 4,873,760 | A | | 10/1989 | Watanabe | |
| 4,885,701 | A | | 12/1989 | Gunderson | |
| 5,016,346 | A | | 5/1991 | Gerst | |
| 5,031,306 | A | | 7/1991 | Schmitt | |
| 5,044,539 | A | | 9/1991 | Hargreaves | |
| 5,172,994 | A | | 12/1992 | Brown | |
| 5,469,204 | A | | 11/1995 | Kim | |
| 5,479,968 | A | | 1/1996 | Sanchez | |
| 5,938,361 | A | | 8/1999 | Yasunaga | |
| 6,076,987 | A | | 6/2000 | Sekine | |
| 6,363,602 | B1 | | 4/2002 | Clark | |
| 6,425,702 | B1 | | 7/2002 | Brunetti | |
| 6,725,539 | B2 | | 4/2004 | Parkhill | |
| 6,755,222 | B2 | * | 6/2004 | Kondo et al. | 141/129 |
| 7,076,866 | B2 | | 7/2006 | Iannucci | |
| 7,111,379 | B2 | | 9/2006 | Chen | |
| 8,061,791 | B2 | | 11/2011 | Iftime | |
| 8,123,424 | B2 | | 2/2012 | Chang | |
| 8,226,073 | B2 | | 7/2012 | Li | |
| 8,844,581 | B2 | | 9/2014 | Higai | |
| 2002/0139436 | A1 | * | 10/2002 | Rosen et al. | 141/86 |
| 2003/0138284 | A1 | * | 7/2003 | Burden et al. | 401/194 |
| 2006/0010680 | A1 | | 1/2006 | Chen | |
| 2010/0229737 | A1 | | 9/2010 | Ouchi | |
| 2010/0269322 | A1 | | 10/2010 | Jendrichowski | |
| 2013/0168202 | A1 | | 7/2013 | Dong | |
| 2014/0260502 | A1 | | 9/2014 | Wang | |

* cited by examiner

FLAT-PEN AUTOMATIC ASSEMBLY LINE

TECHNICAL FIELD

Embodiments of the invention relate to an assembly line system and, in particular, a flat-pen automatic assembly line system.

BACKGROUND

There are various kinds of flat pens, such as markers, felt-tip pens, fiber-tip pens, fluorescent markers, whiteboard pens, and others that require assembly using various parts. The assembly procedure of a flat pen is mainly in the form of an assembly line, wherein the pens are assembled piece by piece in different, separate assembly processes. The assembly procedure of a flat pen mainly includes a wraparound-core mounting process, an ink-filling process, a pen-tip mounting process, a pen-cap mounting process, a pen-cap pressing process, and the like. The pen-cap pressing process is a manual operation. The operator wears hardboard on his/her hand and then presses the pen-cap via the hardboard in order to fasten the pen cap. Efficiency can be very low. During the operating procedure, it is easy for the operator to injure his/her hand by the repetitive force of the hardboard. Further, in the assembly procedure in the form of an assembly line, at least one operator is required for each process, so the conventional process is very labor intensive. Furthermore, when one process has been completed, it is necessary to transfer the semi-assembled products to the worktable for the next process. Because the semi-assembled products are often transferred manually, not only is the assembly efficiency very low, but it is easy for the semi-assembled products to be damaged during transferring. The result is waste and low efficiency in assembling pens.

SUMMARY

Disclosed is an assembly line system for assembling pens, such as flat pens including markers, felt-tip pens, fiber-tip pens, and the like.

One embodiment of an assembly line system includes a worktable; a first sprocket positioned on a first side of the worktable and a second sprocket positioned on the second, opposite side of the worktable; a chain connecting the two sprockets; a plurality of jigs adapted to receive pen barrels provided on the chain; and an automatic pen-cap pressing machine positioned in proximity to the chain.

The assembly line system includes an endless loop chain looped around the first and second sprockets. The chain is adapted to carry the jigs along the worktable.

The automatic pen-cap pressing machine includes a pressing rod positioned above the jigs and in line with the jigs, and the pressing rod is adapted to move vertically.

The automatic pen-cap pressing machine may include a first frame and a first cylinder, wherein the first cylinder is fixed on the first frame, and the rod is fixed on a cylinder shaft of the first cylinder. The pressing rod may be cantilevered from the first frame in order to allow space for the chain and jigs to pass underneath.

The assembly line system may further include an automatic ink-filling machine and an automatic pen-tip pressing machine, wherein all three machines are positioned in proximity to the chain, and on the same worktable.

The automatic pen-tip pressing machine may include a pressing die positioned above the jigs and in line with the jigs, and the pressing die is adapted to move vertically, wherein a lower end of the pressing die is provided with a groove that conforms to a pen tip. The pressing die may be cantilevered so as to allow room for the chain and jigs to pass underneath.

The automatic pen-tip pressing machine may include a second frame and a second cylinder. The second cylinder is fixed on the second frame, and the upper end of the pressing die is fixed on a cylinder shaft of the second cylinder.

The connection between the cylinder shaft of the second cylinder and the pressing die can be detachable.

The sprockets, the automatic ink-filling machine, the automatic pen-tip pressing machine, and the automatic pen-cap pressing machine may be controlled via a programmable logic control module. Further, the automatic ink-filling machine, the automatic pen-tip pressing machine, and the automatic pen-cap pressing machine can be provided with a photoelectric sensing device to detect the presence or absence of pen barrels arriving and departing from the machines. Additionally, all the machines can be positioned in close proximity with the chain and on the same worktable.

In one embodiment, the pens and pen barrels assembled using the disclosed embodiments include pen barrels that have a flat surface covering a majority of at least one side of the pen barrel.

A method of assembling pens includes the steps of providing pen barrels on a chain in jigs attached to the chain, filling the pen barrels with ink, mounting pen tips on the pen barrels, pressing the pen tips to the pen barrels, mounting pen caps on the pen barrels, and pressing the pen caps on the pen barrels, wherein each of the steps is performed on a single worktable adapted to support the chain.

As will be appreciated from the disclosure herein, the pen-cap mounting station and the pen-cap pressing station are provided on the worktable successively, the pen-cap mounting process and the pen-cap pressing process are completed on the same worktable, and these two processes are linked via the driving chain. Therefore, assembly time is shortened and assembly efficiency is improved. Furthermore, an automatic pen-cap pressing machine is provided at the automatic pen-cap pressing station, so the pen-cap pressing process may employ an automatic operation. Therefore, labor can be reduced, and assembly efficiency can be improved. After the pen cap pressing process has been completed, the flat pen is transferred by the driving chain, and the flat pen drops into the receiving box due to gravity as the driving chain rotates around and below one of the sprocket. Therefore, the receiving operation can be completed automatically to reduce labor even further.

When a feeding station, an ink-filling station, a pen-tip mounting station and a pen-tip pressing station are provided on the same worktable successively, the pen-tip pressing station is located upstream of the pen-cap mounting station, and each station is linked via the driving chain. The assembly line system is formed on a single worktable. Labor is reduced, and the need to transfer semi-assembled pens is eliminated. Thus, assembly efficiency can be very high.

When the ink-filling station is provided with an automatic ink-filling machine and the pen-tip pressing station is provided with an automatic pen-tip pressing machine, the ink-filling process, the pen-tip pressing process, and the pen-cap pressing process may employ an automatic operation. Therefore, assembly efficiency can be very high. Furthermore, the assembly procedure has six stations, and can be built on a single worktable, thus, requiring two operators who are responsible for the feeding station, the pen-tip mounting station, and the pen-cap mounting station. Thus, labor can be reduced.

When the automatic pen-tip pressing machine includes a second frame, a second cylinder, and a pressing die, the second cylinder is fixed on the second frame, one end of the pressing die is fixed on the cylinder shaft of the second cylinder, and the other end of the pressing die is provided with a groove conforming to the pen tip. The breakage of the pen tip and the incorrect mounting of the pen tip can be avoided. Thus, the number of defective pen tips is reduced. When the connection between the cylinder shaft of the second cylinder and the pressing die is detachable, the pressing die can be exchanged according to the specification of the pen tip, thus the assembly line system can adapt to various kinds of flat pens.

When the automatic ink-filling machine, the automatic pen-tip pressing machine, and the automatic pen-cap pressing machine are each provided with a photoelectric sensing device, these photoelectric sensing devices may be employed to monitor whether the previous process has been missed or not. If it is detected that a process was missed, the automatic ink-filling machine, the automatic pen-tip pressing machine, and the automatic pen-cap pressing machine can suspend operation. When it is detected that the missed process is completed, operations can resume. Therefore, unnecessary operation of the automatic ink-filling machine, the automatic pen-tip pressing machine, and the automatic pen-cap pressing machine can be avoided, and the operation accuracy and the lifetime of these machines can be improved.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Embodiments of the invention relate to the assembly of apparatus such as pens. Specifically, embodiments relate to assembly line systems including a multiplicity of automatic assembly processes on the same worktable.

Pens may include markers, felt-tip pens, fiber-tip pens, and the like. A pen may be assembled from a barrel or pen barrel, a wrap-around core used to hold ink placed inside the pen barrel, and a pen tip used to transfer the ink from the core to the writing surface. The pen tip is coupled to or partly embedded within the wrap-around core. A pen cap is used to close the pen barrel to prevent the ink from drying. While a flat pen may be described herein as a representative pen that is assembled using the disclosed embodiments, this is done for illustration purposes only and is not meant to be limiting. A pen may include any writing instrument.

Figure 1:
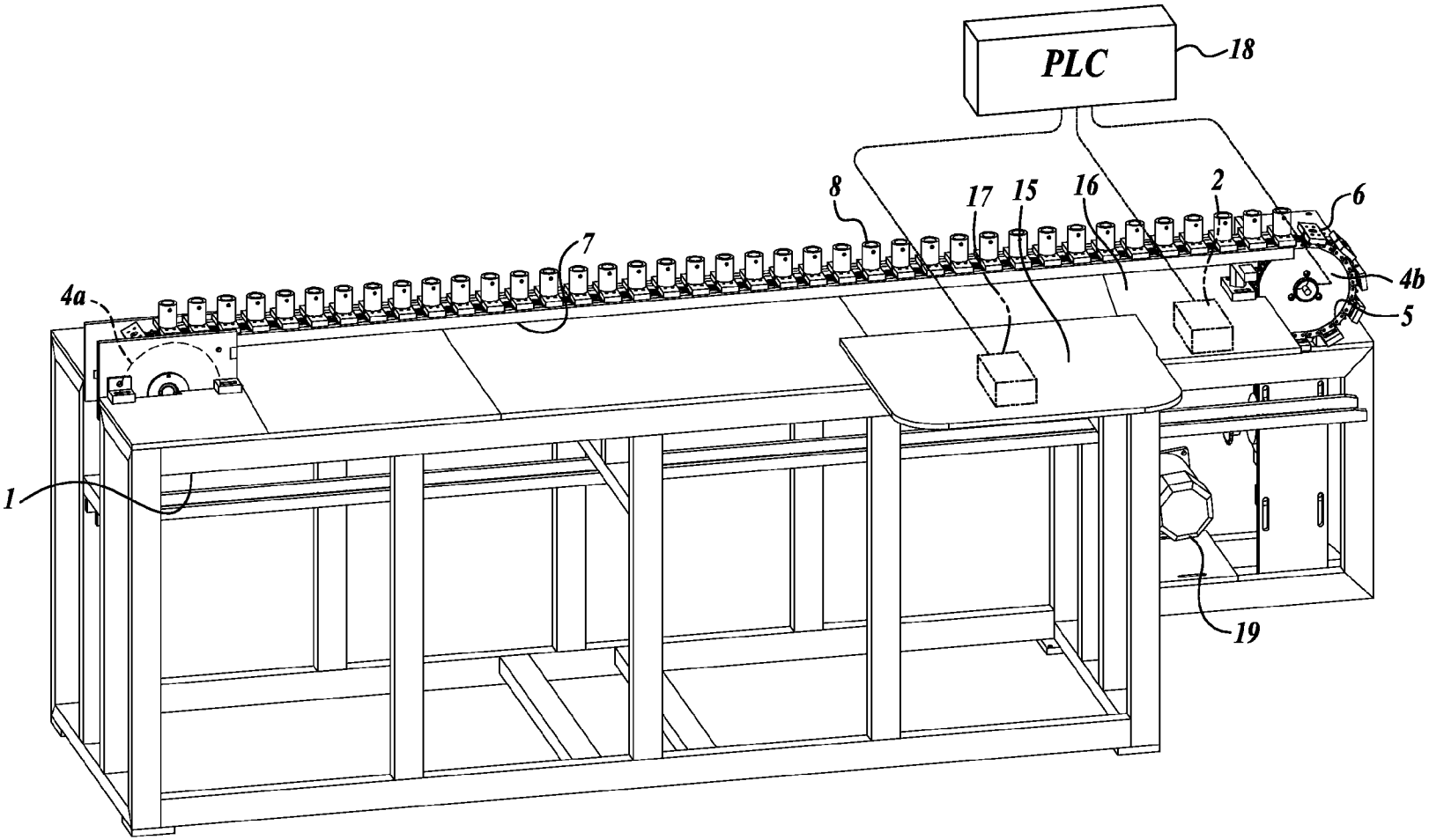
FIG. 1 schematically shows the structure of an assembly line system.

As shown in FIG. 1, a flat-pen automatic assembly line system may include a worktable 1, two driving sprockets 4*a* and 4*b*, and an endless loop driving chain 5 connecting the two driving sprockets 4*a* and 4*b*. As used herein, "automatic" may mean an operation performed wholly or partly by a machine. The two sprockets 4*a* and 4*b* are mounted at the two opposite ends of the same worktable 1, respectively. One sprocket may be a drive sprocket, while the second sprocket may be an idler sprocket. The drive sprocket, for example, sprocket 4*b*, may be driven to rotate by electrical motor 19. In this case, the sprocket 4*a* is the idler sprocket. However, the drive sprocket may be sprocket 4*a* and the idler sprocket would then be sprocket 4*b*.

A plurality of jigs 6 are provided on the plurality of chain 5 links, one jig for each link, for example. A jig 6 is adapted to receive empty pen barrels 8 in a feeding process. A jig 6 may include a generally flat member with a hole sized to snugly receive a pen barrel 8. The driving chain 5 transfers the jigs 6 and, thus, pen barrels 8 from left to right in the figure. A transporting rail 7 supporting the driving chain 5 is provided between the two sprockets 4*a*, 4*b*. The transporting rail 7 is fixed on the worktable 1.

A pen-cap mounting station 15 and a pen-cap pressing station 16 are provided on the same worktable 1 successively. A "station" as used herein is a mechanism provided on the worktable 1 or along the chain 5 for performing an assembly process. In some embodiments, a station is simply an area where the process is performed manually, i.e., by a human operator. In some embodiments, a station may have a machine that can fully or partially perform the process. The pen-cap pressing station 16 can be provided with an automatic pen-cap pressing machine 2 in proximity to the chain 5 carrying the jigs 6, and pen barrels 8.

Figure 2:
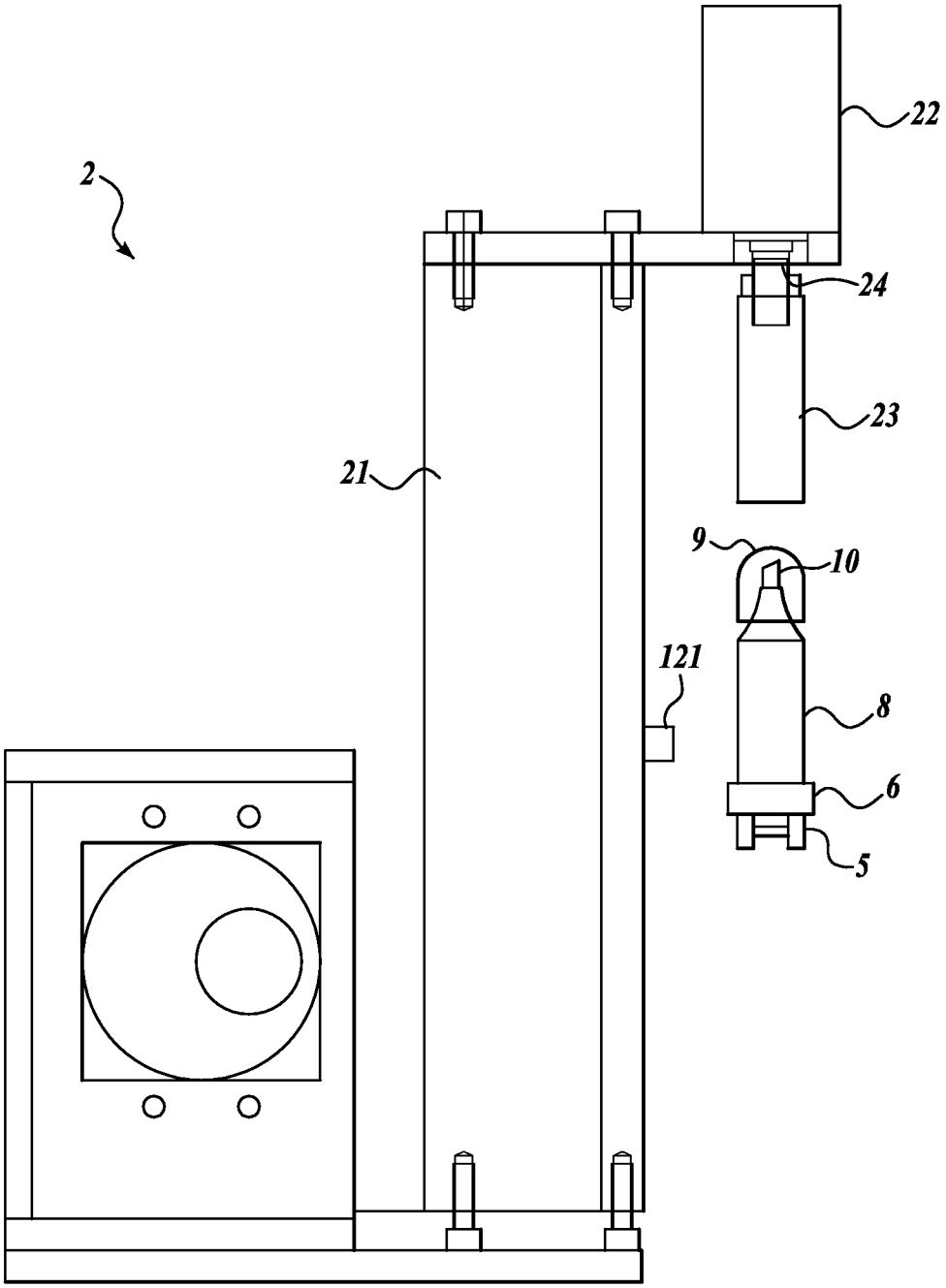
FIG. 2 schematically shows the structure of an automatic pen-cap pressing machine.

As shown in FIG. 2, the automatic pen-cap pressing machine 2 includes a first frame 21, a first cylinder 22, and a pressing rod 23. The first cylinder 22 is fixed on the first frame 21, and the pressing rod 23 is fixed on the cylinder shaft 24 of the first cylinder 22.

Specifically, the first frame 21 is upright and a cantilevered beam is attached horizontally to the top surface of the first frame 21. The first cylinder 22 is mounted at the cantilevered end of the horizontal beam, such that the shaft 24 is directed in a downward position. The first cylinder 22 may be a pneumatic cylinder that extends the shaft 24 vertically downward upon introduction of air to the cylinder. The shaft 24 may be retracted inside the first cylinder 22 via a spring once the air pressure is relieved from within the cylinder. The first cylinder 22 is placed over the cantilevered end of horizontal beam in order to allow space for the chain 5 to pass underneath the pressing rod 23.

As shown in FIG. 2, the chain 5 supports a jig 6 carrying a pen barrel 8. The pen barrel 8 has been fitted with both a pen tip 10 and a pen cap 9. The pen cap 9 has been mounted on top of the pen barrel 8. The pen-cap pressing machine 2 is located in proximity to the chain 5, such that the pressing rod 23 is directly above and in line with the jigs 6 holding the pen barrels 8. In this manner, the pressing rod 23 can accurately press the cap 9 onto the pen barrel 8. The pressing rod 23 is adapted for the particular style of pen barrel. The first frame 21 may also include a photoelectric sensing device 121 that detects the presence and absence of a pen barrel 8 being in the correct position underneath the pressing rod 23.

When assembling a flat pen using the automatic assembly line system of this embodiment, one feeding operator and one receiving operator are needed. The feeding operator is responsible for mounting the flat pen barrels 8 onto the jigs 6 and fitting the pen caps 9 over the pen tips 10 of the flat pens 8. The driving sprockets 4*a*, 4*b* drive the jigs 6 forward in the direction from sprocket 4*a* to sprocket 4*b*. When a jig 6 with pen barrel 8 and cap 10 passes by the pen-cap pressing station 16, the automatic pen-cap pressing machine 2 begins to operate. In one embodiment, the photoelectric sensing device 121 may detect when a pen barrel 8 arrives and leaves the pen-cap pressing machine 2. The cylinder shaft 24 of the first cylinder 22 pushes the pressing rod 23 downwards, and the pressing rod 23 presses down the pen cap 9. The pressing rod 23 resets to the retracted position and then waits for the next pen barrel to be positioned underneath.

After the pen cap 9 has been pressed down, the chain 5 advances, incrementally or continuously, until the flat pen 8 along with the jig 6 are transferred over the side of the driving sprocket 4*b*. When the chain 5 turns downward following the curvature of the sprocket 4*b*, the flat pen 8 can drop from the jig 6 into a receiving box due to gravity. The pen-cap pressing station 16 and pen-cap pressing machine 2 can operate automatically, so assembling efficiency can be very high.

Figure 3:
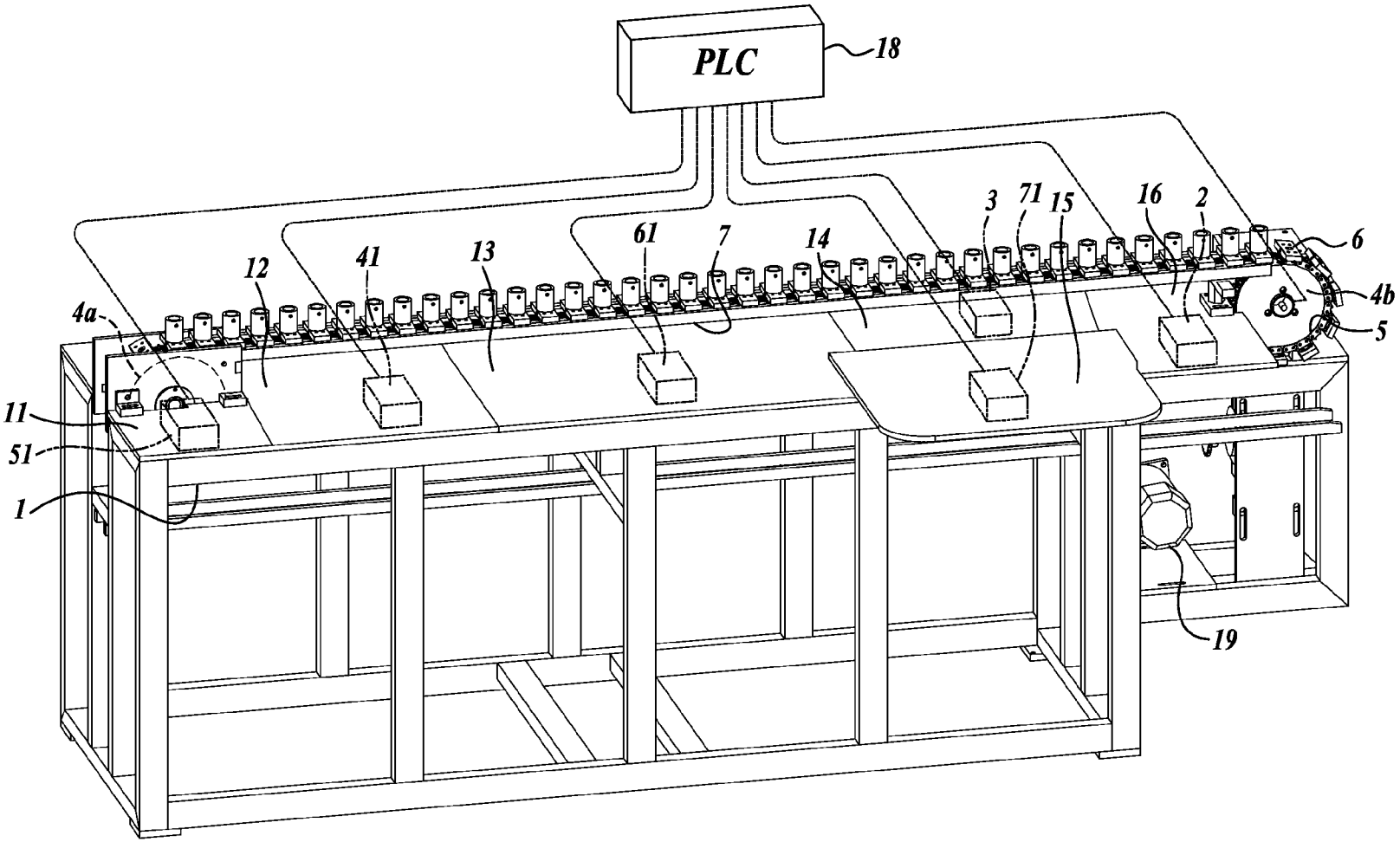
FIG. 3 schematically shows the structure of an assembly line system.

As shown in FIG. 3, an assembly line system of another embodiment is substantially identical to that of the embodiment shown in FIGS. 1 and 2, and the differences are described below.

A feeding station 11, an ink-filling station 12, a pen-tip mounting station 13, and a pen-tip pressing station 14 are provided successively along the same worktable 1, and upstream of the pen-cap mounting station 15 in the assembly line system. The feeding station 11 is provided with an automatic feeding machine 51, the ink-filling station 12 is provided with an automatic ink-filling machine 41, and the pen-tip pressing station 14 is provided with an automatic pen-tip pressing machine 3. The feeding machine 51 automatically loads pen barrels into the jigs 6.

Figure 4:
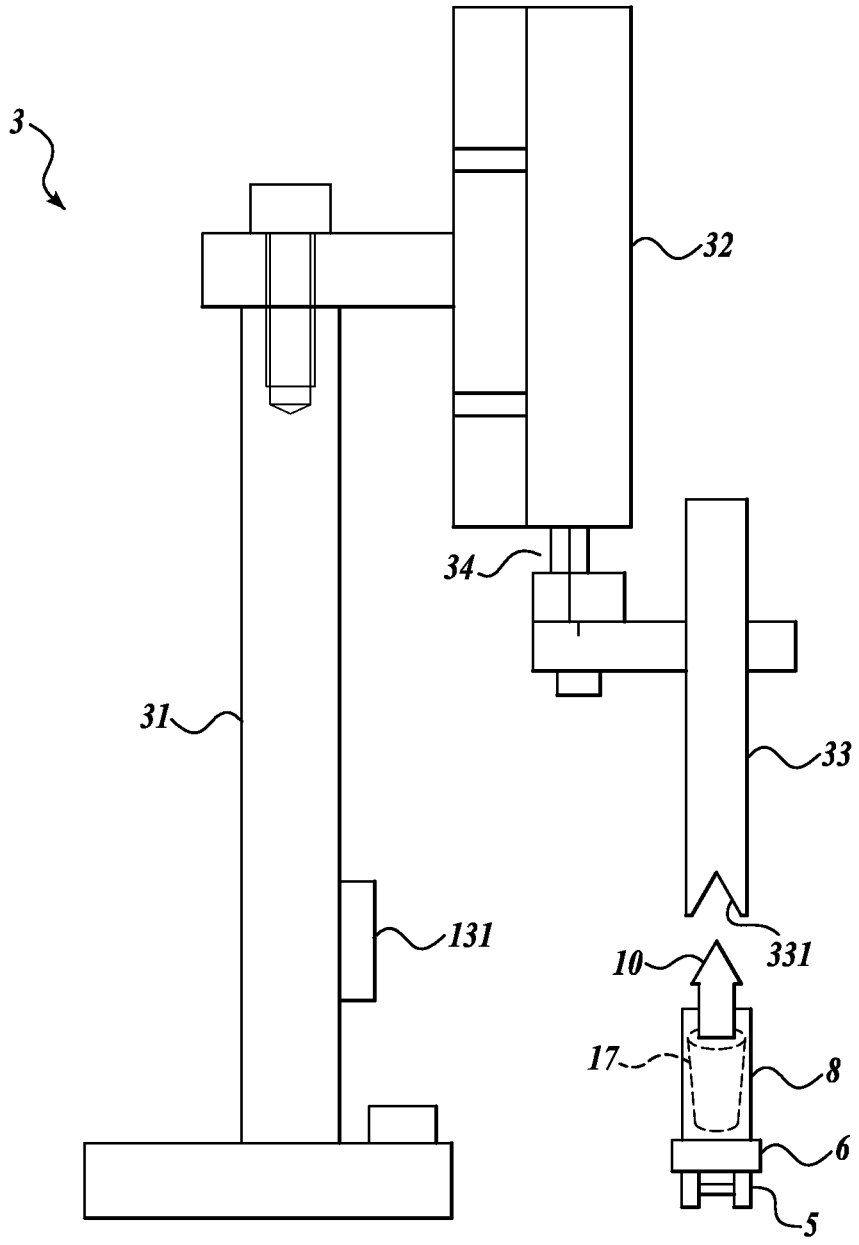
FIG. 4 schematically shows the structure of an automatic pen-tip pressing machine.

As shown in FIG. 4, the automatic pen-tip pressing machine 3 includes a second frame 31, a second cylinder 32, and a pressing die 33. The second cylinder 32 is fixed on the second frame 31, one end of the pressing die 33 is fixed to the cylinder shaft 34 via a chuck, and the other end of the pressing die 33 is provided with a groove 331 conforming to a pen tip 10.

The second frame 31 is an upright structure including a cantilevered beam at the top end thereof. The cantilevered beam has the second cylinder 32 mounted thereon such that the cylinder 32 along with the pressing die 33 is cantilevered to the side of the frame 31. The second cylinder 32 can be a pneumatic cylinder which extends the cylinder shaft 34 downward when pneumatic pressurized air is fed to the cylinder. The cylinder shaft 34 may return to its retracted position with the use of a spring when the air pressure is released from the cylinder. The end of the shaft 34 is linked to the pressing die 33 via a cantilevered beam with a chuck tool so that the pressing die 33 extends further out from the frame 31 compared to the cylinder 32. The chuck tool allows the pressing die 33 to be released so that the pressing die can be interchanged when the shape of the pen tip changes for different pens.

The pen-tip pressing machine 3 also includes a photoelectric sensing device 131 that may be provided on the second frame 31 and senses when a pen barrel 8 is positioned underneath the pressing die 33. For example, the pen-tip pressing machine 3 is located such that a pen barrel 8 carried on a jig 6 on the endless loop driving chain 5 passes underneath the pressing die 33. The construction of the pen-tip pressing machine 3 places the pen-tip pressing machine 3 in proximity to the chain 5, and allows space for the chain 5 to pass underneath the pressing die 33. The pressing die 33 is aligned directly above and in line with the jigs 6.

As shown in FIG. 4, the chain 5 supports a jig 6 that carries a pen barrel 8. The pen barrel 8 has a wrap-around core 17 inside, which has been filled with ink in the ink-filling station 12. The pen tip 10 is placed with the bottom end facing the core 17 and the top end facing the pressing die 33.

An operating principle of the automatic pen-tip pressing machine 3 is as follows. When the flat pen 8 with a pen tip 10 placed above the wrap-around core 17 is fed through the pen-tip pressing station 14, the second cylinder 32 vertically pushes down the pressing die 33 in order that the pen tip 10 is inserted into the groove 331. Further pressing couples or embeds the pen tip 10 in the wrap-around core 17. The second cylinder 32 resets upward, and waits for the next pen barrel to arrive. In one embodiment, a photoelectric sensing device 131 may detect when a pen barrel 8 arrives and leaves the pen-tip pressing machine 3. The photoelectric sensing device 131 can detect when a pen barrel 8 is accurately aligned with the pressing die 33.

In this embodiment, the pen-tip mounting station 13 and the pen-cap mounting station 15 may be operated manually or automatically by a machine. The automatic feeding machine 51, the automatic ink-filling machine 41, the automatic pen-tip mounting machine 61, and the automatic pen-cap mounting machine 71 may employ machines available in the art.

When assembling the flat pen by the automatic assembly line system using a single worktable of the present disclosure, if the pen-tip mounting station 13 and the pen-cap mounting station 15 are operated manually, the process only needs two operators, wherein one operator may feed stock beside the automatic feeding machine and mount the pen cap, while the other operator is responsible for mounting the pen caps and arranging the flat pens in the receiving box. If the pen-tip mounting station 13 and the pen-cap mounting station 15 are operated automatically by machine, the process only needs one operator to feed stock beside the automatic feeding machine and arrange the flat pens in the receiving box. Each of the processes employs automatic operation resulting in very high efficiency.

In the above embodiments, some or all of the driving sprockets 4*a*, 4*b*, the automatic feeding machine 51, the automatic ink-filling machine 41, the automatic pen-tip mounting machine 61, the automatic pen-tip pressing machine 3, the automatic pen-cap mounting machine 71, and the automatic pen-cap pressing machine 2 may be controlled via a programmable logic controller (PLC) module 18. The automatic feeding machine 51, the automatic ink-filling machine 41, the automatic pen-tip mounting machine 61, the automatic pen-tip pressing machine 3, the pen-cap mounting machine 71, and the automatic pen-cap pressing machine 2 may each be provided with a photoelectric sensing device that, in at least some embodiments, provides a signal to the PLC. These photoelectric sensing devices may be employed to signal whether the previous process is completed or not. If it is detected that a flat pen missed the previous process, the automatic feeding machine 51, the automatic ink-filling machine 41, the automatic pen-tip mounting machine 61, the automatic pen-tip pressing machine 3, the automatic pen-cap mounting machine 15, and the automatic pen-cap pressing machine 2 may suspend operation until such time that it is confirmed the missed operation has been completed successfully.

Figure 5:
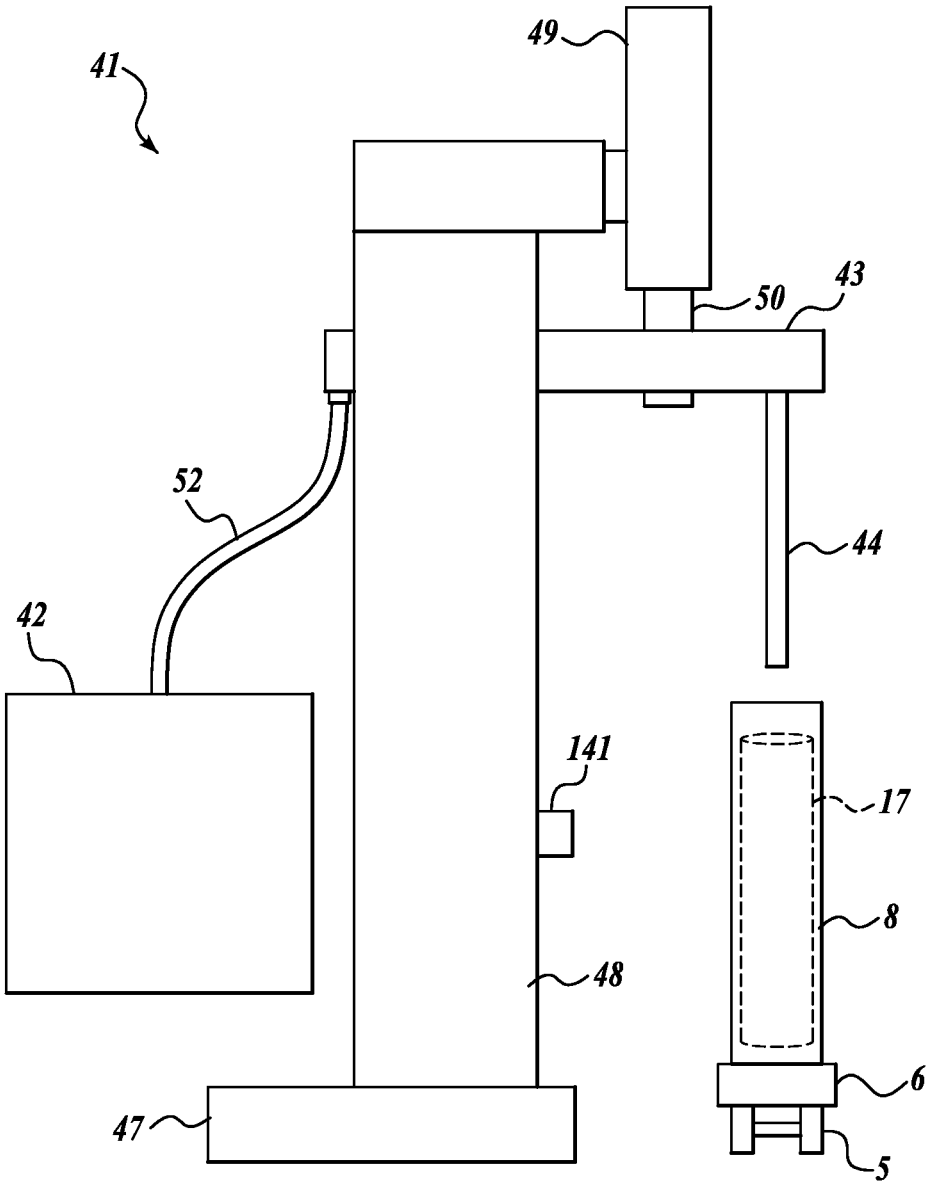
FIG. 5 schematically shows the structure of an automatic ink-filling machine.

FIG. 5 is a schematic illustration of an automatic ink-filling machine 41. The ink-filling machine 41 is placed in proximity to the chain 5. The ink-filling machine 41 includes a third frame 48. The lower end of frame 48 rests on a support base 47. The upper end of the third frame 48 includes a cantilever beam. The cantilever beam supports a third cylinder 49. The third cylinder 49 includes a cylinder shaft 50 connected to an ink-filler arm 43. The third cylinder 49 may be pneumatically activated to lower the ink-filling arm 43 and rise upon relieving the air from the cylinder 49. The ink-filling arm includes an ink-filling needle 44 on a cantilevered end thereof. This construction allows room for the chain 5 and jigs 6 with pen barrels 8 to pass underneath and be directly in line below the ink-filling needle 44. The ink to be delivered to the pen 8 is stored in the ink reservoir 42. The ink reservoir 42 includes a pump to pump the ink through the hose 52 connected to one end of the ink-filling arm 43.

In operation, the jigs 6 carried on chain 5 with pen barrels 8 therein pass underneath the ink-filling needle 44, and the cylinder 49 operates to lower the ink-filling arm 43 with needle 44 into the pen barrel 8. In one embodiment, a photoelectric sensing device 141 may detect the arrival and departure of a pen barrel 8 from the ink-filling machine 41. The photoelectric detecting device 141 can signal when a pen barrel 8 is underneath the ink-filling needle 44. When the photoelectric detector 41 detects a pen barrel 8, the cylinder 49 is activated and lowers the ink-filling arm 43 so that the ink-filling needle 44 is lowered inside of the pen barrel 8. The pump is turned on and a predetermined amount of ink flows from the ink reservoir 42 through the hose 52 and into the ink-filling needle 44. As the pen barrel is filled with ink, the cylinder 49 raises the ink-filling arm 43 while releasing ink to fill the pen barrel 8.

While illustrative embodiments have been illustrated and described, it will be appreciated that various changes can be made therein without departing from the spirit and scope of the invention.

The embodiments of the invention in which an exclusive property or privilege is claimed are defined as follows:

1. An assembly line system for assembling pens, comprising:

a worktable;

a first sprocket positioned on a first side of the worktable and a second sprocket positioned on a second, opposite side of the worktable;

a chain connecting the two sprockets;

a plurality of jigs adapted to receive pen barrels connected to the chain; and an automatic pen cap pressing machine, an automatic ink-filling machine, and an automatic pen-tip pressing machine positioned in proximity to the chain, wherein the automatic pen-cap pressing machine, the automatic ink-filling machine, and the automatic pen-tip pressing machine are configured to operate on pen barrels being carried by the same chain, wherein the automatic pen tip pressing machine comprises a pressing die positioned above the jigs and in line with the jigs, wherein the pressing die is adapted to move vertically, a lower end of the pressing die is provided with a groove conforming to a pen tip, and the automatic pen tip pressing machine comprises a second frame and a second cylinder, wherein the second cylinder is fixed on the second frame, and wherein the upper end of the pressing die is fixed on a cylinder shaft of the second cylinder, and the connection between the cylinder shaft of the second cylinder and the pressing die is detachable.

2. The assembly line system of claim 1, wherein the chain comprises an endless loop chain looped around the first and second sprockets, and wherein the chain is adapted to carry the jigs along the worktable.

3. The assembly line system of claim 1, wherein the automatic pen cap pressing machine comprises a pressing rod positioned above the jigs and in line with the jigs, and wherein the pressing rod is adapted to move vertically.

4. The assembly line system of claim 3, wherein the automatic pen cap pressing machine further comprises a first frame and a first cylinder, wherein the first cylinder is fixed on the first frame, and wherein the rod is fixed on a cylinder shaft of the first cylinder.

5. The assembly line system of claim 1, wherein the sprockets, the automatic ink-filling machine, the automatic pen tip pressing machine, and the automatic pen cap pressing machine are controlled via a programmable logic controller module, and wherein the automatic ink-filling machine, the automatic pen tip pressing machine, and the automatic pen cap pressing machine are each provided with a photoelectric sensing device that provides a signal to the programmable logic controller.

6. The assembly line system of claim 1, further comprising a plurality of pen barrels within the plurality of jigs, wherein the pen barrels have a flat surface covering a majority of at least one side.

* * * * *